US007207275B1

(12) United States Patent
Oertwig

(10) Patent No.: US 7,207,275 B1
(45) Date of Patent: Apr. 24, 2007

(54) FIREARM PROJECTILE

(75) Inventor: Terrance D. Oertwig, West Plains, MO (US)

(73) Assignee: PG Gun Ventures, LLC, West Plains, MO (US)

( * ) Notice: Subject to any disclaimer, the term of this patent is extended or adjusted under 35 U.S.C. 154(b) by 0 days.

(21) Appl. No.: 11/459,740

(22) Filed: Jul. 25, 2006

Related U.S. Application Data

(62) Division of application No. 11/234,613, filed on Sep. 23, 2005.

(51) Int. Cl.
*F42B 30/00* (2006.01)

(52) U.S. Cl. ..... 102/501; 102/525

(58) Field of Classification Search ..... 102/501, 102/525

See application file for complete search history.

(56) References Cited

U.S. PATENT DOCUMENTS

| | | | | |
|---|---|---|---|---|
| 26,016 | A | 11/1859 | Cochran | |
| 40,153 | A * | 10/1863 | Billings | 102/525 |
| 43,615 | A * | 7/1864 | Williams | 102/525 |
| 112,144 | A | 2/1871 | Hotchkiss | |
| 14,315 | A | 8/1874 | Parrot | |
| 178,595 | A | 6/1876 | Butler | |
| 609,003 | A | 8/1898 | Borelli | |
| 1,794,141 | A | 2/1931 | Bloch-Jorgensen | |
| 4,610,205 | A | 9/1986 | Bentley | |
| 4,958,570 | A | 9/1990 | Harris | |
| 5,070,791 | A | 12/1991 | Dineen et al. | |
| 5,443,010 | A | 8/1995 | Dahlitz | |
| 5,458,064 | A | 10/1995 | Kearns | |
| 6,763,765 | B2 | 7/2004 | Crowson | |

OTHER PUBLICATIONS

MDM, "Dyno-Core Magnum," [online], retrieved Aug. 11, 2005 [http://www.emainehosting.com/dyno-core/about.html].

* cited by examiner

*Primary Examiner*—Michael J. Carone
*Assistant Examiner*—Gabriel J. Klein
(74) *Attorney, Agent, or Firm*—Lewis, Rice & Fingersh, L.C.

(57) ABSTRACT

Projectiles for firearms, specifically bullets, are discussed that include a rear thin-walled counter bore. The counter bore is designed to be a first size and shape when the bullet is loaded into the firearm and expand upon discharge of the firearm so as to force the walls of the counter bore into barrel rifling. The expansion may occur through the direct interaction of propellant gases with the counter bore walls, or at least partially indirectly though the inclusion of an expansion plug that is placed at least partially within the counter bore in a manner that the expansion plug can be driven further into the counter bore by the firing action of the firearm.

11 Claims, 8 Drawing Sheets

FIREARM PROJECTILE

CROSS REFERENCE TO RELATED APPLICATION(S)

This application is a Divisional of and claims priority to U.S. patent application Ser. No. 11/234,613, filed Sep. 23, 2005 and currently pending, the entire disclosure of which is herein incorporated by reference.

BACKGROUND OF THE INVENTION (1) Field of the Invention

The present invention relates to a firearm projectile or bullet, specifically a bullet for a firearm which provides for an expanding counter bore to provide decreased contact between the bullet and barrel during loading and with barrel rifling during firing.

(2) Background of the Invention

Hunting and shooting with muzzleloaders is rapidly gaining popularity as a sport. The muzzleloader is essentially a primitive rifle, shotgun, or pistol, based on designs used during the early days of America and lacking the effective range of more modern center fire rifles and the speed of reloading available to cartridge firearms. Because of their popularity, many states have adopted special muzzleloader seasons for hunting with these weapons to allow sportsmen using them (who generally have to get much closer to their targets and be more sure of their aim than those using modern cartridge rifles) to be able to effectively hunt. With the creation of these special seasons, many hunters are moving from more modern rifles to muzzleloaders to take advantage of the special season.

By their very nature, muzzleloaders are essentially primitive firearms, and for many hunters and shooters this primitive nature is part of their appeal. The weapon's decreased effective range requires the hunter to be a more effective stalker. Further, the time it takes to reload a muzzleloader generally means that the hunter gets only a single shot at a target requiring them to be sure of their aim before firing, or to track moving wounded prey. There is also polarization in muzzleloading hunting. Some wish to only utilize traditional firearms and are very interested in the nostalgia, while others are continuously modernizing the "primitive" firearm to provide for improved triggering, safety, and accuracy, while still keeping the tradition of loading powder and shot down the muzzle instead of using a cartridge to make a better firearm for the special season.

As opposed to a more modern firearm which is loaded with a cartridge at the breach, in a muzzleloader loose powder (or powder pellets) and the projectile are loaded into the barrel via the muzzle of the gun and tamped against the breach plug. Because the powder, projectile and percussion cap are separately loaded for each shot and are loaded down the muzzle, the size and shape of the projectile can be very important to insure accurate loading and shooting. To provide for a truer shot, most muzzleloaders utilize a rifled barrel where the interior surface of the barrel is grooved in a helical pattern. The upraised lands in the barrel therefore ideally will contact the bullet as it leaves the barrel imparting spin to the bullet to provide for a more stable shot.

To function most efficiently, muzzle loading firearms require a good gas seal between the propellant charge (powder) and the projectile so that propellant gases cannot escape around the projectile decreasing muzzle velocity. This is called "blowby," Blowby can decrease muzzle velocity and in some cases can even cause the bullet to be deflected from its true path due to propellant gas leakage. In many firearms, a wad or gas check member is placed between the projectile and the powder charge to reduce blowby. The gas check usually serves as the seal and forces the bullet forward in front of the gas check during firearm discharge. Alternatively, the bullet may be wrapped in a cotton or silk wad to try and better seal the bullet itself to form the gas check. This system also helps to hold the bullet in place within the bore during transport of a loaded firearm to prevent the bullet from sliding out of the muzzle if the muzzle was pointed downward. While these systems are more traditional, they often form an inconsistent seal, being less than ideal.

While these initial sealing solutions are still in use, those looking for more modern solutions will often use sabots or gas checks attached to the rear of a bullet instead of wads or separable gas checks to provide for sealing A sabot is generally a more modern bullet casing which surrounds the bullet. The plastic structure lies tightly between the barrel and bullet to form a seal and allow the bullet to leave the barrel without being altered by the act of loading the gun. The bullet does not contact the barrel during loading or shooting so the sabot absorbs all disfiguration.

Sabots were conventionally made of expansive packing material such as molding paper, leather or other materials, but are now almost universally made of a plastic. Plastic sabots generally serve to better seal and prevent "blowby" where propellant gases pass beside the bullet during firing because the plastic can be tightly fit to the barrel without risking damage to the bullet. Resistant plastic is used due to its low cost and its ability to distend during loading, improving the ease that the larger sabot can be rammed down the barrel. The use of plastic sabots, however, presents the problem that they almost universally leave a plastic residue in the barrel from friction against the rifle bore or lands, particularly due to burning of the plastic during firearm discharge. This residue can spoil the ballistic integrity of the barrel after only a couple of shots and requires solvent cleaners to remove. Further, where wrappers or sabots are used, such items engage both bullet and bore surrounding the bullet on the sides and rear. In these cases, the bullet is dependent on the sabot to cause the bullet to spin as the bullet itself does not engage the rifling grooves due to the sabot being on the sides. With these designs, ballistic qualities of the plastic can effect the bullet exiting the bore as the bullet is entirely dependent on the sabot for spin. Further, it is intended that these devices separate from the bullet upon the bullet leaving the barrel so as to avoid them impeding velocity.

To deal with the problems, many individuals have tried to make bullets where the outside surface of the bullet is shaped and sized to interact with the lands without needing a sabot. There are a number of these bullets including those with special rings to interact with the lands and others that include raised sections holding lubricants and the like to smooth bullet passage on loading. The concern with all of these bullets is that in an ideal situation, the bullet will have no contact with the lands when it is loaded in the barrel to make loading easier and prevent residue accumulating. At the same time, these system often have minimal contact with the lands during firing, meaning that spin is not always correctly applied to the bullet, and often still require conventional gas checks to prevent blowby. Additionally, because of the bullet body contact, the firearm is usually more difficult to load and the loading process can be much slower when a follow-up shot may be needed quickly to bring down wounded, and potentially dangerous prey.

More modern bullets utilize integral gas checks attached to the rear of the bullet. These often have the same plastic build up problem as sabots due to them having to be pushed into the barrel and being in contact with the lands to provide for a gas seal. These type of devices also often will utilize differential speeds between the front and back of the bullet to have the bullet expand to contact the rifling. This often results in minimal contact between bullet and rifling during firing. Further, as the gas check is often also in contact with the rifling, interfering contact is possible.

A more problematic issue with sabots and breakaway gas checks is from interference between the sabot or gas check and the bullet as the bullet clears the muzzle. It is intended that as the bullet leaves the barrel, the sabot or gas check will separate from the bullet, flying clear of the bullet which continues to the target. Most of the time, this is accomplished by having the sabot or gas check slow down at a significantly quicker rate than the bullet. In this way the sabot will separate from the rear of the bullet as the bullet flies clear. The problem that has been found is that unless the breakaway system works perfectly every time, the sabot can hit or interact with the bullet as it breaks away spoiling the shot. Further, if there is no breakaway because the gas check begins separate, generally there is the possibility of positioning errors in placing the gas check, also resulting in ballistic effect. This is a major problem with traditional "petaled" sabots, but can also be a problem with plastic gas checks which are connected with centralized pins or other systems. Regardless of the type of device used, interaction of the device with the bullet can alter the bullet's trajectory making it less accurate.

SUMMARY OF THE INVENTION

Because of these and other problems in the art, described herein, among other things, are bullets for a firearm, generally a muzzleloading firearm, which is generally undersized for the caliber of the firearm and includes a rear counter bore and may include an expansion plug. The walls of the bullet counter bore are sized and shaped to provide for limited or no contact with the lands of the bore during loading of the firearm, but good contact with the lands during firing by expansion of the counter bore outward from the major axis of the bullet toward the barrel when the firearm is discharged.

There is described herein, a bullet for a firearm, the bullet comprising: a main body having a main axis and a diameter, said diameter being less than the internal diameter of a barrel of a firearm using said bullet; and a counter bore in the rear of said main body, said counter bore being a hollow recess along said main axis and having walls; wherein said walls are generally barrel-shaped and include: a front portion tapered outward from said main axis, a middle portion rearward of said front portion, said middle portion having a diameter equal to or greater than said internal diameter of said barrel, and a rear portion rearward of said middle portion, tapered inward to said main axis;

In an embodiment, when the bullet is loaded into said firearm, only said middle section is in contact with said barrel, when said bullet is fired, however, said counter bore walls may be pushed outward so that a greater percentage of said walls is in contact with barrel rifling.

In an embodiment, the bullet further comprises an expansion plug, said expansion plug being located at least partially, and sometimes entirely, within said counter bore. The expansion plug may be of generally cylindrical shape with a sealed end or may comprise two hollow cylindrical portions of different diameters and a transition section between them; and wherein a first end of said cylindrical portion with said smaller diameter is sealed. The smaller of said diameters of said cylindrical portions may be less than said diameter of said barrel, and the larger of said diameters of said cylindrical portions may be greater than said diameter of said barrel.

In an embodiment, the expansion plug moves further into said counter bore when said bullet is fired which may cause the walls to be pushed outward by the passage of said expansion plug.

There is also disclosed herein, a bullet for a firearm, the bullet comprising: a main body having a main axis and a diameter, said diameter being less than the internal diameter of a barrel of a firearm using said bullet; and a counter bore in the rear of said main body, said counter bore being a hollow recess along said main axis and having walls; and an expansion plug, placed at least partially, and possibly entirely, within said counter bore, often extending beyond the rear of said counterbore; wherein, when said firearm is discharged, said expansion plug moves within said counter bore and said expansion plug forces said walls to expand away from said main axis.

In an embodiment, the bullets or expansion plugs may be made of metal suchas as, but not limited to, copper or lead.

BRIEF DESCRIPTION OF THE DRAWINGS

FIG. 3 shows the interaction of the bullet of FIG. 1 with the barrel of a muzzle loader.

FIG. 6 shows a rear perspective view of the expansion member of FIG. 5 in the bullet of FIG. 4.

DETAILED DESCRIPTION OF THE PREFERRED EMBODIMENTS

The embodiments of the invention discussed herein are generally designed to be used as a projectile discharged from a firearm. That is, they are bullets. The bullets are discussed in conjunction with a muzzleloading firearm because a muzzleloading firearm generally has a dual problem created because the bullet in a muzzleloader must pass into the barrel first backward as it is loaded, and then forward as it is fired. However, the bullet designs can be used in any type of firearm. During loading of a bullet, it is desirable to minimize contact between the bullet and the rifling to ease loading. Further, as some form of gas check is generally used for improved ballistic performance, it is also desirable to minimize barrel contact with the gas check to improve ease of loading and to inhibit residue formation in the barrel as the bullet and gas check are slid into the barrel. Once loaded, it is desirable to have the gas check and bullet form a sufficient seal with the barrel to secure both objects in the barrel even during movement of the firearm and to protect the powder from moisture. During ignition, it is desirable to form an effective gas seal that will minimize blowby and to have the bullet have good contact with the rifling to provide for accurate spin as the bullet is fired. Finally, as the bullet leaves the muzzle, it is desirable to have the gas check not interfere with the bullet's trajectory or hitting power.

Figure 1:
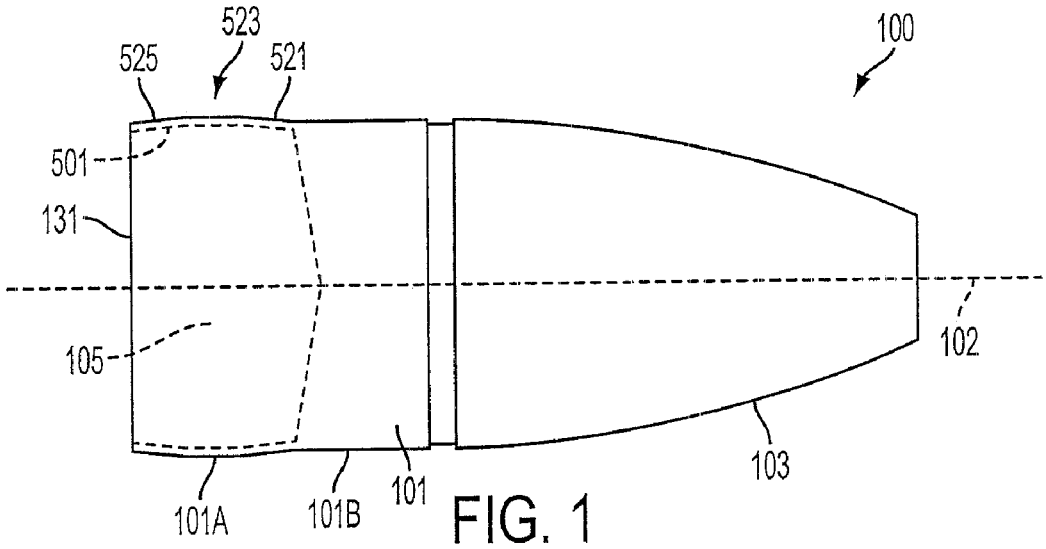
FIG. 1 provides a plan view of a first embodiment of a bullet having a rearward counter bore.
Figure 2:
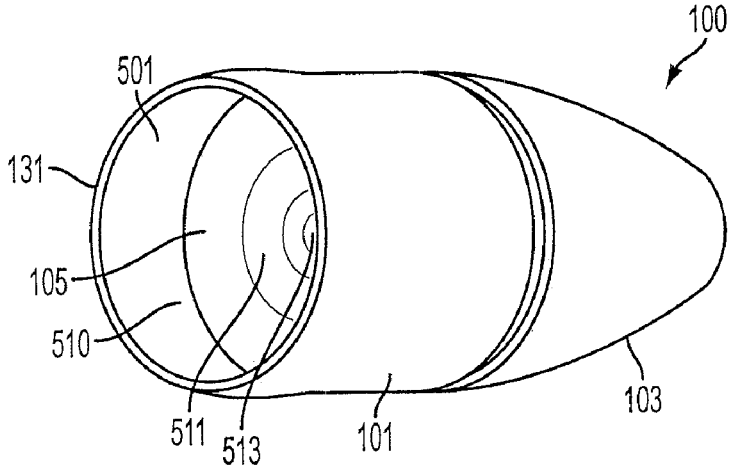
FIG. 2 provides a rear perspective view of the embodiment of FIG. 1

FIGS. 1 and 2 provide a diagram of a first embodiment of a firearm projectile or a bullet (100). The bullet (100) in FIG. 1 utilizes an expanding counter bore (105) having minimal barrel contact during loading, but expands during firearm discharge to provide improved barrel control during firing. The bullet (100) generally comprises a main body (101) and a tip (103). The tip (103) design may be of any type of design known to one of ordinary skill in the art. In the embodiment of FIGS. 1 and 2, the tip (103) is a conical hollow point design of the type known to those of ordinary skill in the art. While this design of the bullet (100) is often preferred for its damage potential on impact, the design of the tip (103) of the bullet (100) does not matter for the operation of the expanding counter bore as discussed herein. Therefore, the tip (103) of the bullet (100) may be of any shape including conical, conical frustum, ogive, blunted ogive, hemispherical, or other shape. The forward end may also be any design including, but not limited to hollow point, solid point or tipped. The bullet (100) may be comprised of any material but is generally comprised of an obturating (expanding) metal, particularly lead or copper. Often a lead bullet will include a copper coating to provide for smoother and cleaner flow of the outer surface against the barrel and to protect the lead from burning during powder discharge.

The bullet (100) will be sized for use with a firearm of a particular bore or caliber. The bore, as used herein, generally refers to the distance (diameter) between the opposing land surfaces of the rifling where the bore is rifled and the distance between opposing inner surfaces where the bore is smooth. The land being the raised portion of a grooved or rifled surface. As an example, in a 50 caliber rifle, opposing land surfaces of the bore will be, ideally, 0.500 inches apart. Obviously the exact distance will often depend on the skill of the gun manufacturer, but the use of the term caliber when referring to the tolerance in this distance is understood in the art. The bullets (100) discussed herein will generally be used in conjunction with rifled barrels, therefore the distance inside the lands as the caliber is most relevant.

The bullet of the embodiments of the FIGS. is preferably designed to have a slightly smaller diameter than is indicated by the bore of the weapon. In effect the bullet (100) is too small for its caliber. In particular, currently when bullets (100) are manufactured they are processed to be equal to the bore size. Therefore a 50 caliber bullet is supposed to be 0.500 inches in diameter and is designed for use in a 50 caliber firearm having a bore diameter also equal to 0.500 inches. Due to machine tolerances, however, the bullet (100) can easily be a few thousands of an inch off in either direction. It is not surprising, due to these tolerances, to open a box of conventional bullets and have some processed to be slightly too small for the barrel, and others processed too large.

The bullet (100) of the instant case is processed to be less than the caliber of firearm in which it is to be used. So, for example, the bullet (100) has a diameter less than 0.500 inches in diameter if sized for use with a 50 caliber firearm. It is preferred that the bullet be no larger than 0.500 inches in diameter even taking into account the machine tolerances in making it. The 50 caliber bullet of FIG. 1 is therefore most preferably between the sizes of 0.498 and 0.500 inches, more preferably being 0.499 inches in diameter.

The undersizing of the bullet (100) for the caliber of the firearm will generally continue throughout most standard bore sizes used on personal firearms with the bullet (100) of the instant case being processed to be slightly smaller than the standard bullet for whichever bore or caliber it is to be used with, generally within 0.002 inches of the bore size. When the expanding counter bore (105) is used in significantly larger bullets, the size range of the diameter may be slightly increased to accept additional machine tolerance as necessary to keep the bullet (100) under the bore size. As the bullet (100) is undersized for the firearm with which it is to be used, it should be apparent that the bullet (100) will usually be able to be loaded into the firearm with relatively minimal contact between the main body (101) and the lands.

In the embodiment of FIG. 1 the bullet (100) is a 50 caliber bullet. The bullet (100) main body (101) which is undersized as discussed above is modified to provide it with an expanding counter bore (105) placed rearward in the main body (101) and extending into the main body (101) from the rear. It is important to recognize here that the counter bore (105) is not an attachment to the rear of the bullet (100), but is actually within the main body (101) of the bullet (100). Depending on embodiment, the bullet (100) may be lengthened to provide for the counter bore (105) without decreasing the weight of the bullet (100), but this is generally not required. The counter bore (105) in a 50 caliber bullet will generally be 0.120–0.200 inches in depth from the rear (131) of the bullet (100) depending on the specific bullet (100) design used.

The counter bore (105) is generally very close in diameter to the diameter of the bullet (100). This means that the counter bore (105) modifies a portion of the main body (101) to no longer be solid but thin walled. It is generally preferred that the wall (501) of the counter bore (105) have a thickness of about 0.01 inches to about 0.03 inches, more preferably about 0.015 inches to about 0.02 inches. This design therefore results in the main body (101) having two portions, the counter bore portion (101A) and the forward portion (101B). The forward portion (101B) is essentially unmodified from the standard bullet design. The walls are generally arranged at a relatively constant distance from the main center axis (102) of the bullet (100).

As the counter bore (105) wall (501) is formed from the material forming the main body (101) of the bullet, the outer wall (501) of the counter bore (105) is generally the same material as makes up the bullet (100). In this manner, the wall (501) of the counter bore (105) is not located between the bullet (100) and barrel (901) of the firearm as is the case with a sabot and there is not a separate piece attached to the rear of the bullet (100). This is best seen in FIG. 3. The material of the wall (501) of the counter bore (105) is preferably continuous with the material forming the forward portion (101B) of the main body (101) of the bullet (100). In the event that the counter bore (105) is used on a copper-coated lead bullet, the inside surface (503) of the counter bore (105) is preferably also coated with copper. In this way the lead in the bullet (100) is not burned by the combustion gases from the propellant. The counter bore (105) may be formed by a variety of methods. In a simple embodiment, the counter bore (105) is formed by precision boring tools hollowing out the rear (131) of the main body (101) of an existing undersized bullet (100). In an alternative embodiment, the bullet (100) may be formed or molded with the counter bore (105) already present. In a still further embodiment, the counter bore portion (101A) of the main body (101) may be manufactured as a separate piece to the forward portion (101B) and tip (103) and then the pieces be permanently attached together. Regardless of the manner of construction it should be recognized that once built, the counter bore section (101A) is not intended to be separated from the remaining bullet (100) components at any time, but is a part of the bullet (100) during all aspects of its flight and impact.

The counter bore (105) is designed to facilitate inter action with the rifling (903) of the barrel (901) when the firearm is discharged, while minimizing bullet (100) contact with the barrel (901) or rifling (903) during firearm loading. This dual purpose is accomplished by having the counter bore (105) expand under force from propellant gas during firing. In the embodiment of FIG. 1, the counter bore (105) wall (501) will, along a portion of its length, engage the barrel (901) to hold the bullet (100) in place prior to firing. This portion also serves as a gas check during firing to prevent escape of gases during firing of the bullet (100). The counter bore (105) also expands during firing under force from propellant gas in the counter bore (105) to increase contact between the barrel (901) and the bullet (100), improving rifling interaction and accuracy.

In the embodiment of FIG. 1, the counter bore (105) is in the shape of a hollow opening (510) having a generally constant radius about the main axis (102) and having a tapered upper section (511) leading to a point (513). The tapering is not required but is generally present if the counter bore (105) is formed into the bullet (100) using drill bits or boring tools. The counter bore (105) may be cylindrical in shape behind the tapered upper section (511), but it is preferred that the counter bore (105) not be entirely cylindrical, but have a number of different subsections, in this case three.

In the embodiment of FIG. 1 there are provided three subsections making up the counter bore wall (501) providing a resultant form which is generally barrel-shaped. The three subsections (521), (523), and (525) work together to provide for both an integral gas check, and improved contact with rifling when the bullet (100) is fired. The innermost subsection (521) is tapered outward so as to extend from the main axis (102) of the bullet (100). In effect it is a transition section from the undersized forward portion (101A) of the main body (101) to the middle section (523). The middle section (523) preferably has a greater diameter than the forward portion (101A) and is designed to act as the gas check. Generally, the middle section (523) will have a diameter above that specified for the caliber of the firearm for which the bullet (100) is indicated. The final section (525), in the rear of the bullet (100), tapers back inward toward the main axis (102) from the middle section (523) decreasing the diameter.

Each of the sections (521) (523) and (525) is designed for a particular purpose and to interact with both the barrel (901) and propellant gases in a particular way. Generally, the middle section (523) is designed to serve as a gas seal being in contact with the barrel (901) prior to the firearm being discharged. In the depicted embodiment the middle section's (523) diameter is between 0.004 and 0.006 inches larger than the diameter of the main body (101), more preferably about 0.005 inches larger than the diameter of the front portion (101A) of the main body (101). As the main body (101) is undersized for the firearm, this will generally make the middle section (523) about 0.002 to 0.006 inches larger than the caliber of the firearm. When the bullet (100) is loaded down the barrel (901), the middle section (523) will press against the rifling (903) as the bullet (100) is loaded providing a secure seal. It should be readily apparent, that the amount of contact the middle section (523) has with the barrel (901) is significantly less than the contact of a bullet (100) correctly or overly sized for the caliber of the firearm. This both decreases resistance of the bullet (100) during loading, making it easier to load the firearm, and eliminates plastic residue being deposited inside the gun as the middle section (523) is constructed of the same material as the bullet (100) which is generally metal.

As a gas check, the middle section (523) will act to prevent blowby on the bullet (100) and will instead generally direct propellant gases (911) into the counter bore (105). This serves two purposes. Principally, propellant gas (911) in the counter bore (105) pushing against the top surface (527) of the counter bore (105) will serve to push the bullet (100) from the barrel (901) discharging the firearm. However, the gas (911) inside the counter bore (105) will also serve to expand the counter bore (105) walls (501) into contact with the rifling. This generally takes place in the front (521) and rear (525) subsections of the counter bore (105) walls (501). In effect, the barrel-shaped counter bore (105) will become more cylindrical upon the discharge and generally of larger diameter than the diameter of the bullet (100).

Figure 3A:
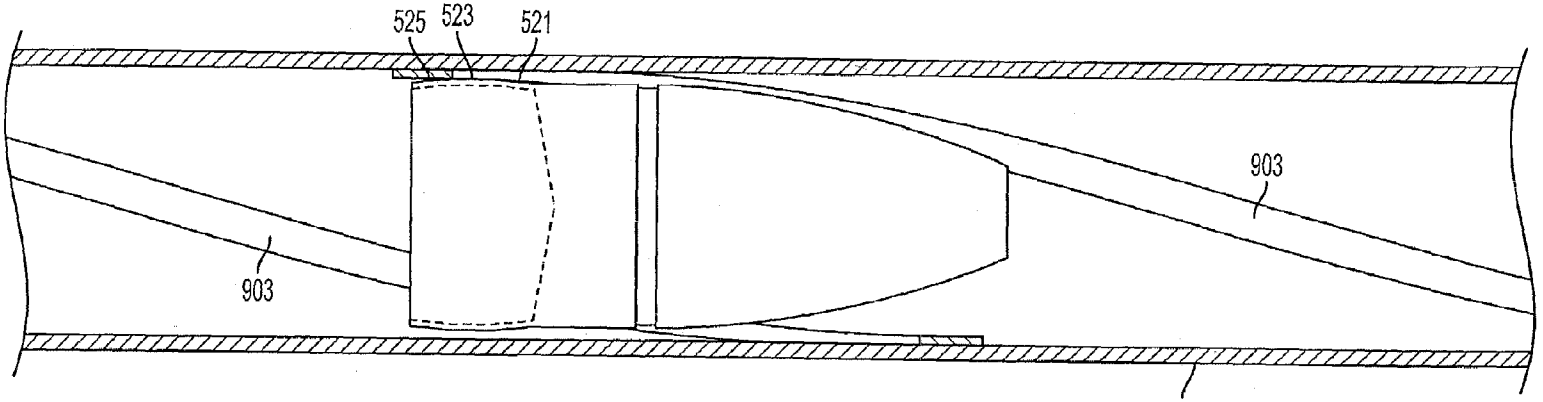
FIG. 3A is during loading.
Figure 3B:
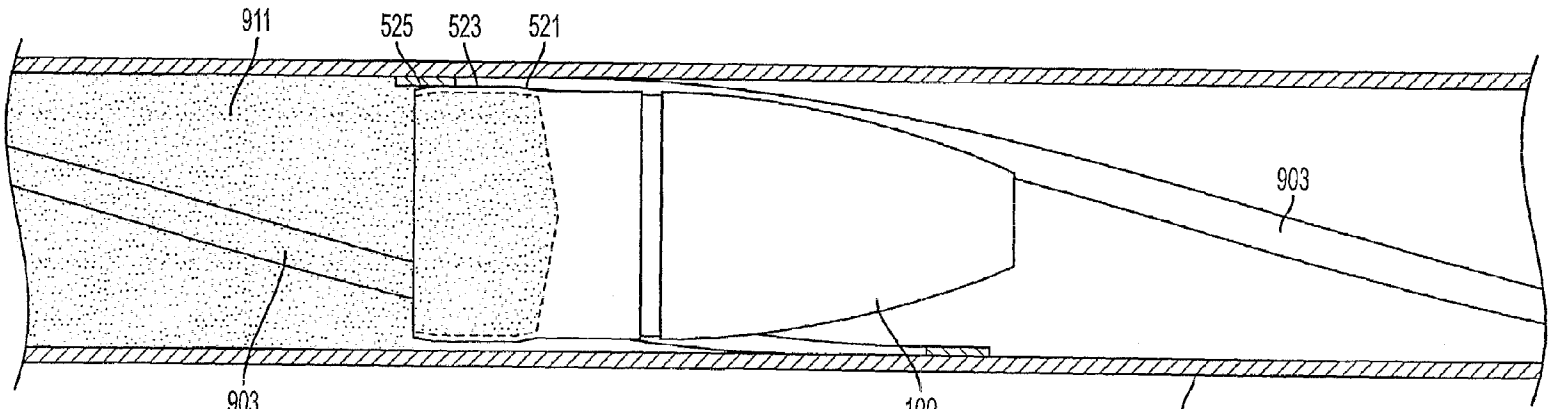
FIG. 3B is during firing.

The front section (521) of the counter bore (105) wall (501) is generally designed both as the support between the middle section (523) and the front portion (101A) of the main body (101), and to expand outward from pressure due to the gases (911) of the ignited powder being inside the counter bore (105). When the propellant is ignited, gas pressure (911) will build up inside the counter bore (105), this will generally cause the weaker outer wall (501), which is capable of expanding, to expand in this subsection (521). This is shown in the comparison of FIG. 3A to FIG. 3B.

In order to make an undersized bullet (100) contact rifling, it is common that the sudden acceleration from behind the bullet (100) be used to expand the diameter of the rear of the bullet (100) simply because as the rear accelerates while the front is not yet moving, the rear will compress forcing material outward. This is not particularly effective, however, as it only results in a minimal amount of the bullet (100) contacting the rifling surfaces. In the depicted embodiment, however, the propellant gases (911) are directed into the counter bore (105), as their pressure increases they will not only begin to push the mass of the bullet (100) forward expanding the rear or the front portion (101A) of the main body (101) as shown in FIG. 3B, but will also push outward on the counter bore (105) walls (501) toward the barrel (901). This is a much more effective method for increasing contact as it does not rely on compression due to differential velocity, but instead directly uses differential pressure. In this way, the front section (521) of the counter bore (105) (and in fact some area in front of the counter bore (105) in some cases) is pushed outward by the propellant gas (911) expansion inside the counter bore (105) and is forced into contact with the rifling when the firearm is discharged. The back section (525) also generally experiences such expansion. It has been found that about ⅔ of the total length of the counter bore (105) will be in sufficient contact with the rifling to be scored by the rifling on discharge. This is about double the amount of surface area in contact with the rifling when the bullet (100) is loaded.

The rear subsection (525) is preferably tapered inward to improve ease of placing the bullet (100) in the barrel (901) and to provide that the counter bore (105) walls (501) are not damaged during insertion. The tapering can also help to insure sufficient propellant gases (911) are directed inside the counter bore (105). By tapering the wall (501) inward in the rear section (525), when the bullet (100) is pushed backward down the muzzle, it will generally pass over the lands of the rifling without the walls (501) catching on them as they are smoothly directed over the outer surface. This helps to insure that the shape of the counter bore (105) is not altered by deformation. Further, the tapering in of the rear section (525) will generally help the bullet (100) to seat over the powder charge, particularly a pelletized powder charge of the type favored in more modern muzzleloaders. The tapering effectively draws the end of the powder pellets (913) into the counter bore (105), centering the pellets (913) behind the bullet (100) and insuring that explosive gases (911) from the pellets (913) are released into the counter bore (105) to provide explosive force to push the wall (501) of the counter bore (105) outward from the main axis (102) and into contact with the rifling of the barrel (901). This is best shown in FIG. 3A.

The counter bore (105) will generally provide for multiple beneficial results in firing. In the first instance, there will often be increased muzzle velocity of the bullet (100) because the middle section (523) forms a gas check. It is also believed that the counter bore (105) will increase accuracy and shot stability because the bullet (100) has a more solid contact with the rifling during firing. As the counter bore (105) of the "undersized" bullet (100) obturates it provides for a localized area of metal which is actually part of the bullet (100) to utilize the rifling and impart spin to the bullet (100), but that area is significantly greater than the area of an undersized bullet using a sabot or plastic gas check that contacts the rifling instead of the bullet (100). Further, in this embodiment, the counter bore (105), being manufactured of bullet (100) material and being effectively part of the bullet (100) will not leave plastic residues or interfere with the bullet's (100) trajectory as the counter bore (105) travels with the bullet (100) to its terminal destination. As it is not intended to separate from the bullet (100) and does not hinder the bullet (100) in flight, there is no concern from separation. This design therefore eliminates the need for a clean breakaway of gas check material, without impairing the bullet ballistics, making for a more reliable and consistent flight.

Figure 4:
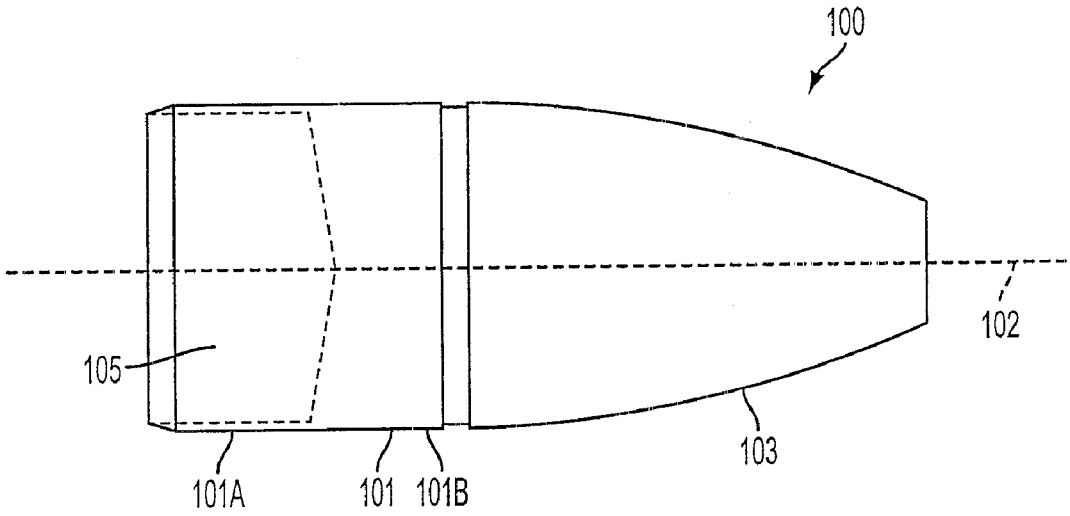
FIG. 4 shows a plan view of a second embodiment of a bullet having a rearward counter bore.
Figure 5A:
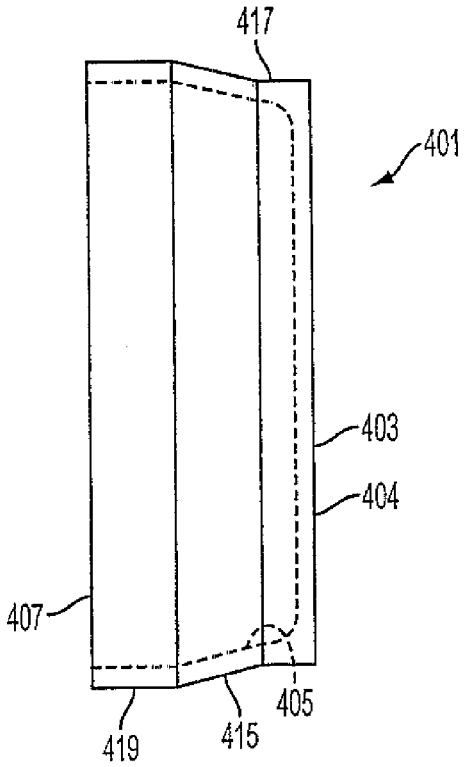
FIG. 5A shows a plan view with FIB. 5B shows a top view.
Figure 5B:
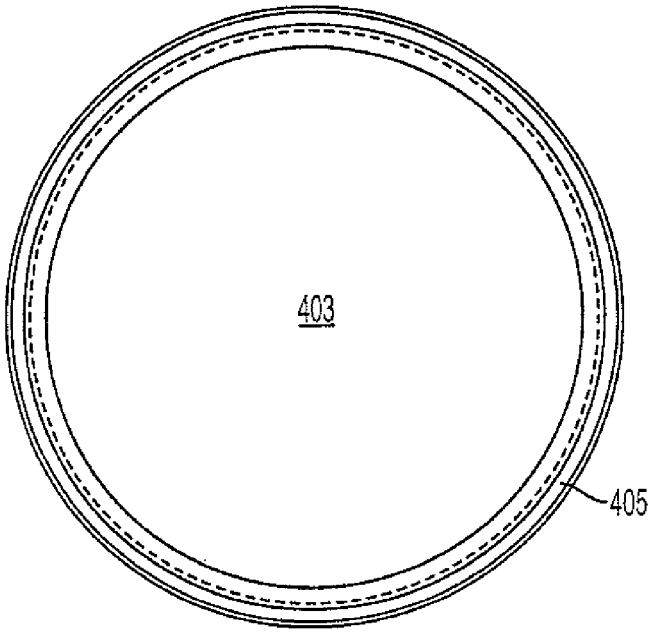
FIG. 5 shows an expansion member for use with the bullet of FIG. 1 or 4.
Figure 6A:
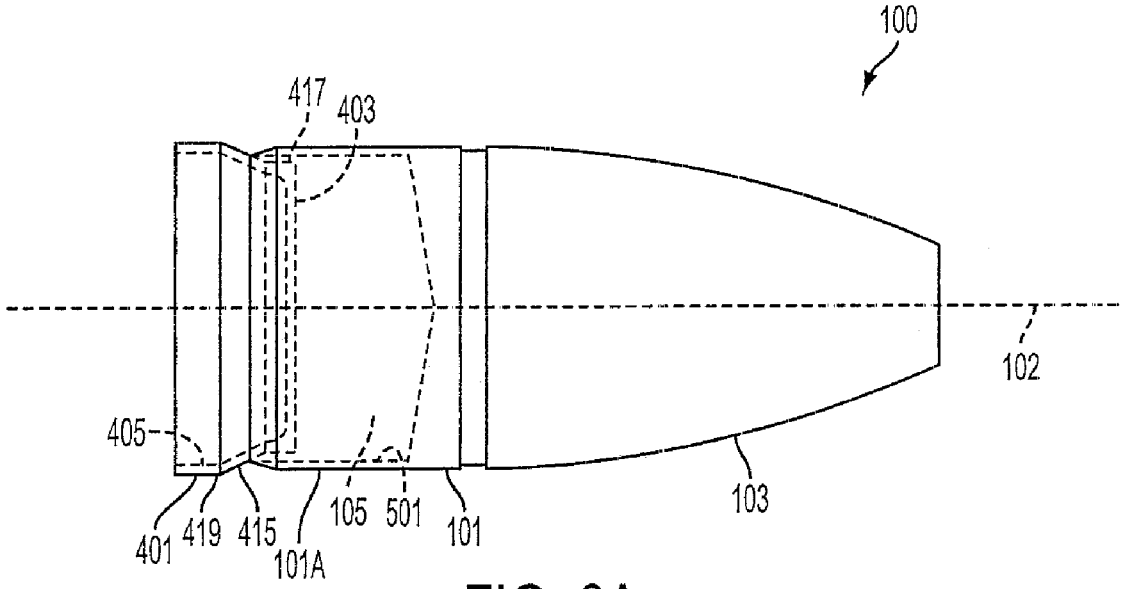
FIG. 6A is during loading.
Figure 6B:
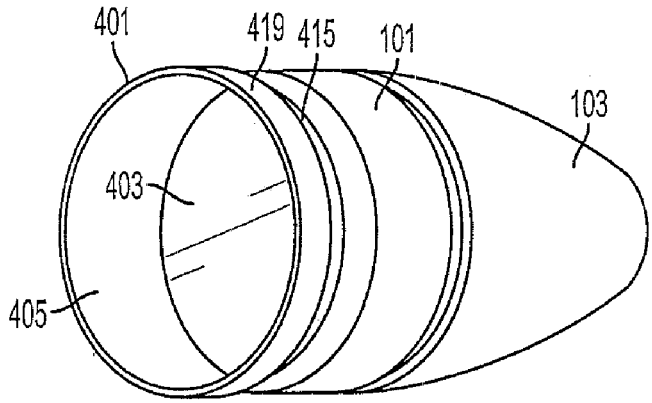
FIG. 6B is during firing.

FIGS. 4–7 provide for an alternative embodiment of the counter bore (105). In this case, the counter bore (105) expansion is facilitated through the use of an expansion plug (401). The counter bore (105) may be of the shape discussed above or may be of a more constantly cylindrical shape as shown in the embodiment of FIG. 4. As shown in FIGS. 5 and 6 there is also included a expansion plug (401). The expansion plug (401) will generally be of a hollow design having a sealed top end (403) and thin walls (405). It is preferred that the expansion plug (401) be shaped such that the rearward end (407) of the expansion plug (401) is of greater diameter than the forward end (409). Any shape of expansion plug (401) having this quality may be used including, but not limited to, a conical frustum, A shape comprising tapered cylinders as shown in FIG. 5 is particularly preferred. In this design the shape comprises a front cylindrical ring (417) and a rear cylindrical ring (419) where the rear cylindrical ring (419) has a greater diameter than the front cylindrical ring (417). The two rings are then connected by a central tapered portion (415). The front cylindrical ring (417) will generally be arranged so as to have an outer diameter equal to or less than the inner diameter of the counter bore (105); however, it may be slightly larger if desired. The rear cylindrical ring (419) will generally have an outer diameter equal to or greater than the outer diameter of the front section (101A) of the bullet (100). It is preferred that the diameter be about 0.003–0.005 inches above the caliber of the bullet (100) in which it is to be used. In effect, the rear cylindrical ring (419) is therefore of similar dimension to the middle section (525) of the counter bore (105) in the embodiment of FIG. 1.

The expansion plug (401) may be made of any material but it is particularly desirable to have it constructed from a fairly strong obturating material, particularly a metal. In a preferred embodiment, the expansion plug (401) is constructed of copper or copper coated lead so as to be of the same material as the bullet (100) to which it is to be attached.

Figure 7A:
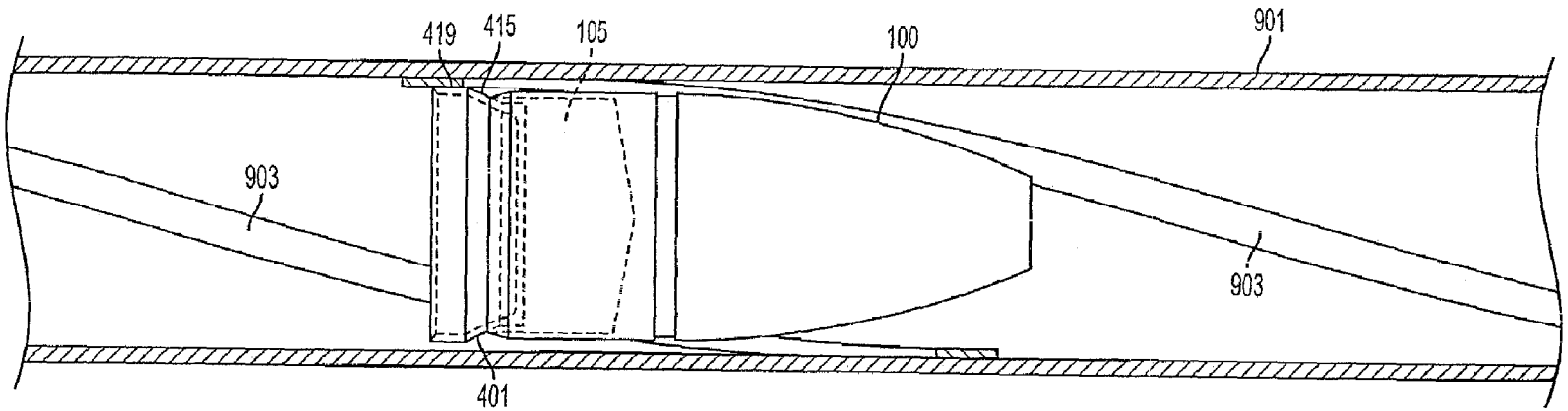
FIG. 7 shows the interaction of the assembly of FIG. 6 with the barrel of a muzzle loader.

In operation, the expansion plug (401) is placed into the counter bore (105) at the rear of the bullet (100) prior to loading. This is shown in the embodiment of FIG. 6. Generally, the expansion plug (401) will be inserted by the user by hand or will come preassembled in the counter bore (105). The two items are generally only held together by friction, there is preferably no adhesive or other connection used to hold the two components together. In the case of FIG. 6 where the expansion plug (401) of FIG. 5 is used, generally the expansion plug (401) will be inserted into the counter bore (105) so that the front cylindrical ring (417) is entirely within the counter bore (105) and the counter bore (105) wall (501) is resting against a portion of the intermediate section (415). The bullet (100) and expansion plug (401) are then inserted as a unit into the firearm over the propellant as is shown in FIG. 7A.

Figure 7B:
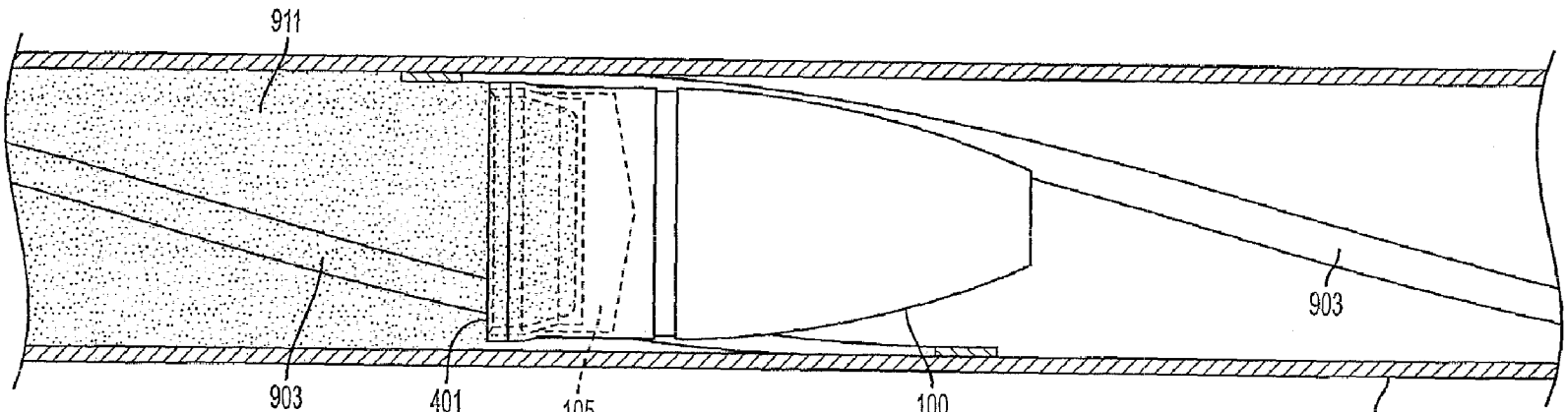

Generally, the rear cylindrical ring (419) of the expansion plug (401) will contact the rifling inside the barrel (901). This occurs as the bullet (100) is inserted in much the same fashion that the middle section (523) of the bullet (100) of FIG. 1 contacted the barrel (901) in the first embodiment. The bullet (100), in this case will preferably not be in contact with the barrel (901) in a significant fashion when inserted as it is entirely undersized and the counter bore (105) wall (501) has not been modified to include a larger diameter section as discussed in conjunction with FIGS. 1–3. However, the counter bore (105) shown in FIGS. 1–3 can be used with an expansion plug in an alternative embodiment which would result in contact between the bullet (100) and barrel (901) during loading. The rear cylindrical ring (419) will therefore serve as the principal gas seal. The frictional connection between the expansion plug (401) and the counter bore (105) will serve to hold the bullet (100) in position in the barrel (901) even without the bullet (100) directly contacting the barrel (901). When the propellant is ignited, the propellant gases (911) will generally be directed inside the expansion plug (401). This will propel the expansion plug (401) forward. Due to the frictional connection between the expansion plug (401) and the counter bore (105), generally the expansion plug (401) will begin moving forward before the bullet (100) begins moving forward. The expansion plug (401) will therefore be pushed deeper into the counter bore (105). This pushing action will serve to drive the wall (301) of the counter bore (105) over the intermediate section (415) as shown in FIG. 7B. Due to the increase in diameter from the intermediate section passing into the counter bore (105), the wall (501) of the counter bore (105) is forced outward into the rifling of the barrel (901) from the expansion plug (401) being forced into the counter bore (105). The expansion plug (401) will generally be unable to crush inward because the propellant gases (911) will be exerting pressure inside the expansion plug (401). Once the expansion plug (401) has traveled a short distance inside the counter bore (105), the friction between the counter bore (105) and expansion plug (401) will be sufficient that the force from the propellant will begin to move the expansion plug (401) and the bullet (100) along the barrel (901). As should be apparent from FIG. 7B, at this time, the outer wall (501) of the counter bore (105) has expanded to be in contact with the rifling and the bullet (100) will start rotating in accordance with the rifling from this interaction.

When the bullet leaves the barrel of the firearm, one of two things will happen. If the expansion plug (401) is sufficiently small, the expansion plug (401) may now be solidly held inside the counter bore (105) and will travel with the bullet (100) until the target is impacted. In most cases, however, the expansion plug (401) will extend beyond the back of the bullet (100). As soon as the bullet (100) clears the barrel, the expansion plug (401) will begin to slow down in speed relative to the bullet (100). This may be partially due to drag, but is more generally due to the relatively small mass of the expansion plug (401) compared to the mass of the bullet (100). Therefore, the expansion plug (401) will effectively drop out the back of the counter bore (105) and quickly lose speed and fall to the ground as it lacks aerodynamic shape.

Because the attachment of the expansion plug (401) to the bullet (100) is by friction only, detachment between bullet (100) and expansion plug (401) upon firing of the firearm is generally clean. As opposed to sabots, the expansion plug (401) cannot impact the side of bullet (100) after leaving the muzzle of the firearm as it does not extend around the sides of the bullet (100) to begin with. Further, as the expansion plug (401) is forced into the counter bore (105) during firing, the assemblage will generally be rotated by the rifling as a single unit as opposed to a gas check placed behind the bullet. The frictional connection also avoids problems with a breakaway gas check where imperfect breakage can result in poor ballistics. The expansion plug (401) will generally either separate cleanly, or not separate at all.

Figure 8:
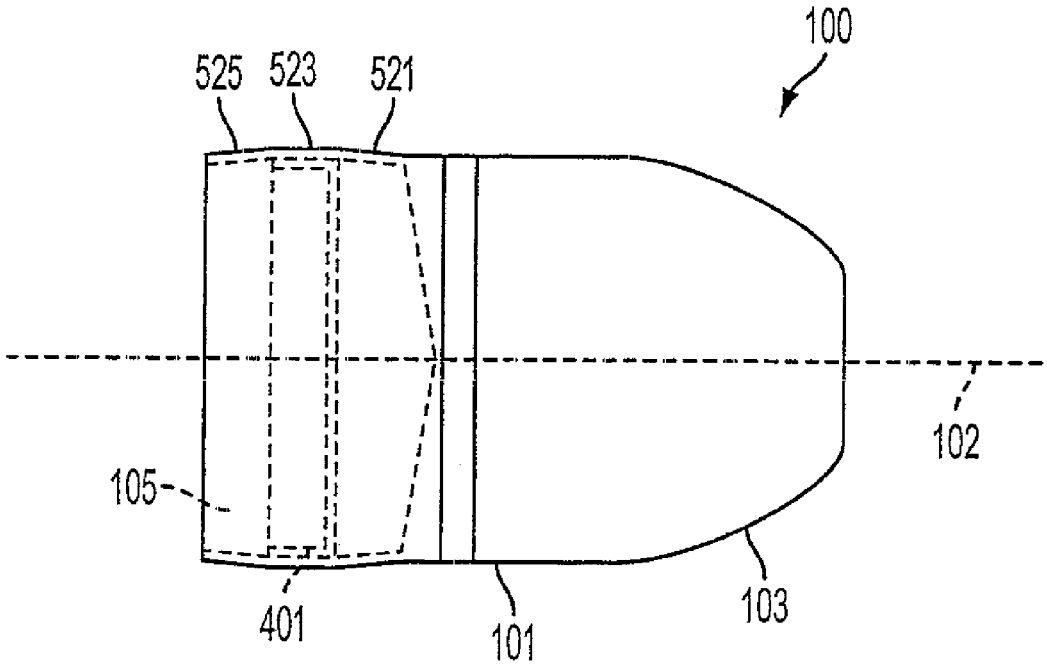
FIG. 8 shows a plan view of a third embodiment with a rearward counter bore; this embodiment includes an internal expansion member.
Figure 9:
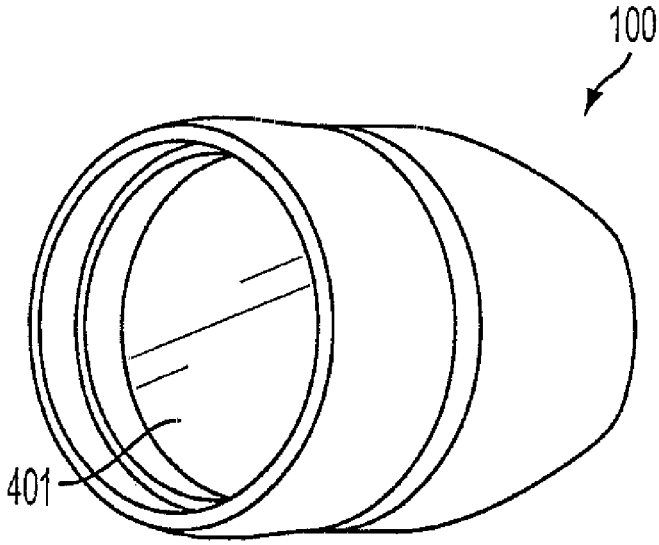
FIG. 9 shows a rear perspective view of the embodiment of FIG. 8.
Figure 10A:
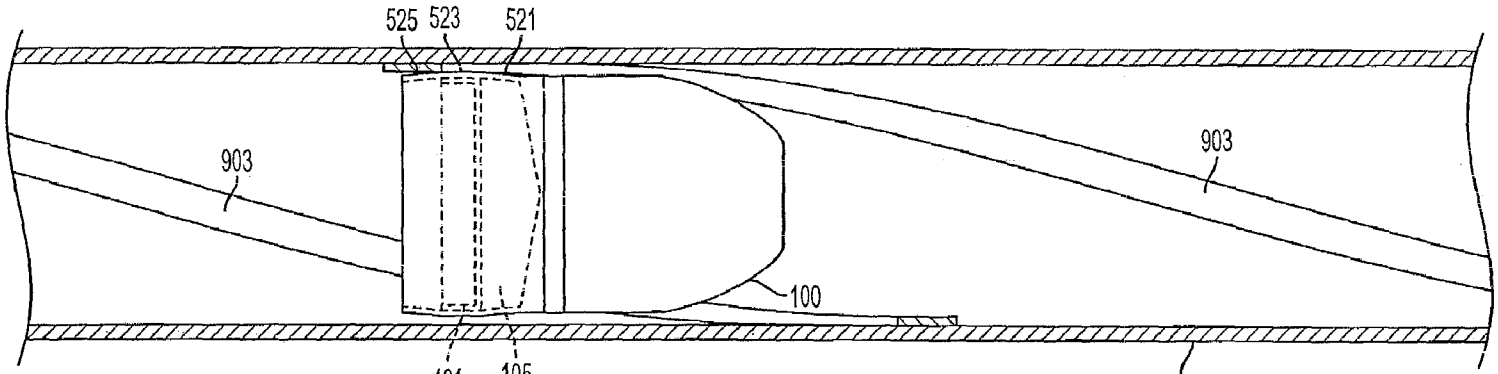
FIG. 10 shows the embodiment of FIG. 8 interacting with the barrel of a muzzle loader, FIG. 10A during loading.
FIG. 10B is during firing.
Figure 10B:
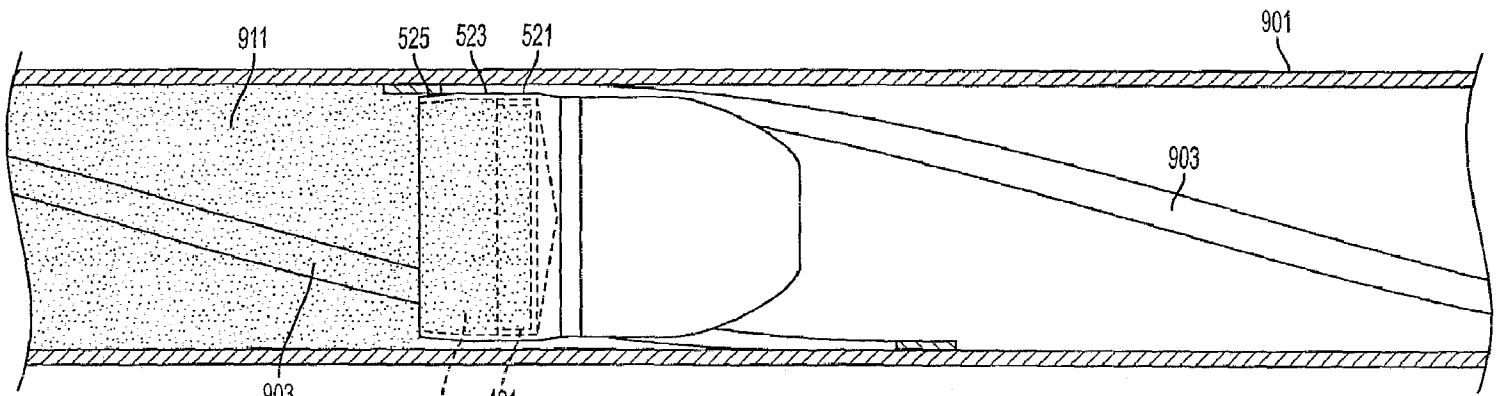

FIGS. 8–10 show a still further embodiment of a bullet (100). In this embodiment, an expansion plug (401) similar to that of FIGS. 4–7 is used, however, in this case, the expansion plug (401) is significantly smaller in length and only has a single diameter. This expansion plug (401) is placed entirely inside the counter bore (105) as opposed to the embodiment of FIGS. 4–7 where the expansion plug (401) extended beyond the rear of the counter bore (105). In this embodiment, as the expansion plug (401) is inside the counter bore (105) it is preferred that a bullet sized and shaped in accordance with the embodiment of FIG. 1 is used. The expansion plug (401) is generally sized and shaped to fit fairly tightly inside the middle section (523). When the propellant is ignited, the expansion plug (401) is pushed forward, in this case helping the expansion of the front section (421) of the counter bore wall by forcing the expansion plug (401) into that section. In this case, the expansion plug (401) is more likely to stay within the counter bore (105) after the bullet (100) leaves the muzzle as it effectively is part of the bullet (100) due to its internal positioning, but that is by no means required.

This third embodiment is generally not as desirable as the second embodiment because it requires more precise placement of the expansion plug (401) in the counter bore (105). If the expansion plug (401) in this third embodiment is not placed so that the propellant gases (911) will drive it along the main axis of the bullet (100), it can potentially deflect the bullet (100) by engaging it at an angle. The embodiment of FIG. 2, having a tapered portion on the expansion plug (401) will generally not have this issue as the easiest movement is generally along the axis of the bullet (100) resulting in a level of self aligning. This embodiment can utilize tapering on the outside wall of the expansion plug (401) in an embodiment to provide for easier positioning.

All of the above bullets (100) provide for a number of benefits over the use of traditional gas checks or other wads to inhibit blowby. In the first instance, the bullet (100) itself, or the metal expansion plug (401) is being used to inhibit blowby which does not result in as much residue being left in the barrel (901) as is the case when plastic is used as the gas check. This can dramatically improve the firearms ability to be fired repeatedly without needing to be cleaned. Further, plastic, even when fairly rigid, does not generally provide as secure a seal as metal.

As should be apparent in all the above embodiments, the area of the bullet (100) which is to interact with the rifling (the counter bore section (101B)) is altered between loading and discharge. The bullet (100) is easily inserted as only a small percentage of its surface area is in contact with the barrel (901) at that time. Further, damage to the bullet (100) from loading is relatively minimal. The area of the bullet (100) in contact with the barrel (901) is, however, expanded when the bullet (100) is fired providing for improved interaction with the barrel (901) and more accurate spin on the bullet (100) by providing sufficient surface area to assure good contact with rifling. Still further, as the material of the bullet (100) itself is interacting with the rifling when the bullet (100) is fired, the spin imparted by the rifling is imparted directly to the bullet (100) which can insure that the correct spin is imparted to the bullet (100) prior to it leaving the barrel (901).

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A bullet for a firearm, the bullet comprising:

a tip;

a main body connected at the front of said main body to said tip and having a main axis; and a counter bore in the rear of said main body, said counter bore being a hollow recess along said main axis and forming walls;

wherein said main body is generally cylindrical and has a diameter less than the caliber of a firearm using said bullet between said counter bore and said tip; and wherein said walls of said counter bore include: a front portion tapered outward from said main axis, a middle portion rearward of said front portion, said middle portion having a diameter equal to or greater than said caliber; and a rear portion rearward of said middle portion, tapered inward to said main axis.

2. The bullet of claim 1 wherein when said bullet is loaded into said firearm, only said middle portion is in contact with barrel rifling of said firearm.

3. The bullet of claim 2 wherein, when said bullet is fired, said counter bore walls are pushed outward so that a greater percentage of said walls is in contact with barrel rifling.

4. The bullet of claim 1 further comprising an expansion plug, said expansion plug being located at least partially within said counter bore.

5. The bullet of claim 4 wherein said expansion plug is located entirely within said counter bore.

6. The bullet of claim 4 wherein said expansion plug is of generally cylindrical shape with a sealed end.

7. The bullet of claim 4 wherein said expansion plug comprises two hollow cylindrical portions of different diameters and a transition section between them, and wherein a first end of said cylindrical portion with said smaller diameter is sealed.

8. The bullet of claim 7 wherein the smaller of said diameters of said cylindrical portions of said expansion plug is less than said caliber, and the larger of said diameters of said cylindrical portions is greater than said caliber.

9. The bullet of claim 4 wherein said expansion plug moves further into said counter bore when said bullet is fired.

10. The bullet of claim 9 wherein when said expansion plug moves further into said counter bore, said walls are pushed outward by the passage of said expansion plug.

11. The bullet of claim 4 wherein said expansion plug separates from said counter bore after said firearm is discharged.

* * * * *